US006742231B1

(12) United States Patent
Calhoun et al.

(10) Patent No.: US 6,742,231 B1
(45) Date of Patent: Jun. 1, 2004

(54) CAP PANEL INSERT USABLE IN DISH ASSEMBLIES OF BOTH CUT TOP AND FULL TOP CASKETS

(75) Inventors: Rosalie J. Calhoun, Osgood, IN (US); Anthony S. Casablanca, Batesville, IN (US); Lola J. Fisher, Batesville, IN (US); Gary M. McBreen, Ross, OH (US); Dale E. Oliver, Batesville, IN (US); Charles F. Winburn, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 326 days.

(21) Appl. No.: 09/494,028

(22) Filed: Jan. 28, 2000

(51) Int. Cl.[7] ..... A61G 17/00
(52) U.S. Cl. ..... 27/19; 27/14
(58) Field of Search ..... 27/19, 14, 2, 16, 27/15

(56) References Cited

U.S. PATENT DOCUMENTS

| | | | | |
|---|---|---|---|---|
| 610,537 | A | | 9/1898 | Hiser et al. |
| 995,549 | A | | 6/1911 | Mowen |
| 2,042,849 | A | | 6/1936 | Jacques |
| 2,964,824 | A | | 12/1960 | Hillenbrand |
| 3,157,936 | A | * | 11/1964 | Hillenbrand |
| 3,835,509 | A | * | 9/1974 | Esterdahl |
| 4,137,613 | A | * | 2/1979 | Ceresko |
| 4,357,741 | A | * | 11/1982 | Winburn et al. |
| 4,730,370 | A | | 3/1988 | Elder |
| 4,944,076 | A | | 7/1990 | Kay et al. |
| 5,495,648 | A | * | 3/1996 | Rojdev et al. |
| 5,535,489 | A | | 7/1996 | Cunagin et al. |
| 5,535,490 | A | | 7/1996 | Neth |
| 5,632,073 | A | | 5/1997 | Foye |
| 5,634,247 | A | * | 6/1997 | Bowling |
| 5,636,419 | A | * | 6/1997 | Foye |
| 5,675,877 | A | | 10/1997 | Lewis |
| 5,832,643 | A | * | 11/1998 | Delaquila et al. ..... 40/611 |
| 6,151,762 | A | * | 11/2000 | Cox |

* cited by examiner

*Primary Examiner*—William L. Miller
(74) *Attorney, Agent, or Firm*—Wood, Herron, & Evans, L.L.P.

(57) ABSTRACT

A cap panel insert which is usable in dish assemblies of both cut top and full top caskets. A dish assembly adapted to be positioned in a lid of a full top casket comprises a cap panel sized and configured to fit within the full top casket lid and puffing members attached to the panel around its periphery, a first cap panel insert overlying the cap panel, and second and third cap panel inserts positioned at opposite longitudinal ends of the first cap panel insert and overlying the cap panel. The first cap panel insert is sized and configured to fit within a dish assembly of a cut top casket.

38 Claims, 3 Drawing Sheets

CAP PANEL INSERT USABLE IN DISH ASSEMBLIES OF BOTH CUT TOP AND FULL TOP CASKETS

FIELD OF THE INVENTION

This invention relates generally to caskets, and more particularly to the decorative interiors thereof.

BACKGROUND OF THE INVENTION

A casket has a body containing shell and at least one cover or lid, sometimes referred to as a "cap," enclosing the shell. In the case of so-called "full top" or "full couch" caskets, the casket has a single, full length lid. In the case of so-called "cut top," "split top" or "half couch" caskets, the casket has a pair of lids: a head end cap and a foot end cap. During viewing of a body in a cut top casket, only the head end cap is raised, while during viewing of a body in a full top casket, the single full length cap must of course be raised.

When the cap of a casket is raised during for example a body viewing, the underneath side of the cap becomes visible to the public. It is thus desirable to have the underneath side of the cap attractively trimmed and adorned with decorative fabric or the like to present an aesthetically pleasing sight. A "dish assembly" is typically installed into the underneath side of a casket cap to provide just such adornment. A dish assembly comprises a rectangular "cap panel" to which is attached convex shaped "puffing members" around the periphery thereof. The cap panel and puffing members are fabricated of a relatively stiff yet flexible board material know as "chipboard," and the puffing members are typically covered with decorative fabric. The dish assembly may be supported within the cap by, for example, the support of the assignee's U.S. Pat. No. 5,632,073, which is hereby incorporated by reference herein as if fully set forth in its entirety. A rectangular cap panel insert, including decorative fabric and/or embroidery or the like, may be removably installed between the four puffing members and in juxtaposition relative to the cap panel, to provide a means of personalizing the casket. Various means may be provided to secure the cap panel insert into the dish assembly, for example such as that disclosed in the assignee's U.S. Pat. No. 5,675,877, which is hereby incorporated by reference herein as if fully set forth in its entirety.

It will be appreciated then that separate dish assemblies must be constructed for cut top and full top caskets. Thus, a manufacturer of both cut top caskets and full top caskets must stock both cut top dish assemblies and full top dish assemblies for installation into its cut top and full top caskets. It would be desirable to devise a system whereby at least a portion of the dish assembly of a cut top casket could be used in the dish assembly of a full top casket and vice-versa, in order to reduce such cost-ineffective duplication of materials and labor.

SUMMARY OF THE INVENTION

Accordingly, the invention is a cap panel insert which is usable in dish assemblies of both cut top and full top caskets. According to the invention, a dish assembly adapted to be positioned in a lid of a full top casket comprises a cap panel sized and configured to fit within the full top casket lid and puffing members attached to the panel around its periphery, a first cap panel insert overlying the cap panel, and second and third cap panel inserts positioned at opposite longitudinal ends of the first cap panel insert and overlying the cap panel. The first cap panel insert is sized and configured to fit within a dish assembly of a cut top casket.

The second and third inserts are preferably sized and configured so that the first insert may be positioned centrally longitudinally of the cap panel. The second and third inserts are also preferably reversible end-to-end of the cap panel. Thus, only a single such insert need be manufactured and stocked. An integral edge portion of a respective one of the second and third inserts may overlie a respective end edge portion of the first insert. A decorative trim piece may further preferably cover adjacent end edge portions of the first, second and third inserts. Each such decorative trim piece may be integral with a respective one of the second and third inserts. In a preferred form, each trim piece is an accordian folded end edge portion of the second and third inserts. Alternatively, each decorative trim piece may be a separate piece attached over adjacent end edge portions of the first, second and third inserts. In that case each trim piece may include decorative, for example shirred, fabric thereon.

In another aspect of the invention, there is provided a conversion kit for converting a cap panel insert sized and configured for a cut top casket lid for use in a full top casket lid. The conversion kit comprises a pair of conversion cap panel inserts, both of which are sized and configured to be positioned at opposite longitudinal ends of the cut top casket lid cap panel insert, such that the cut top casket lid cap panel insert and the pair of conversion cap panel inserts cover a cap panel of a dish assembly sized and configured for installation in the full top casket lid.

In yet another aspect of the invention, a conversion cap panel insert is provided for use in converting a cut top casket cap panel insert to one for use in a full top casket. The conversion cap panel insert comprises a generally rectangular panel board covered with fabric and a generally rectangular trim board, also covered with fabric, and having a longitudinal edge portion overlying and secured to a longitudinal edge portion of the panel board.

Preferably, the panel board fabric is stapled to a back side of the panel board along three edges, and along a fourth edge, the panel board is first stapled to the fabric covered trim board and then the panel board fabric along that fourth edge is folded back upon the panel board and is stapled thereto. Vinyl tape preferably overlies the connection of the panel and trim boards on respective back sides thereof.

The invention also provides methods of manufacturing cut top and full top caskets utilizing the "universal" cap panel insert and conversion kit cap panel inserts.

The major advantage of the present invention is that only a single "universal" cap panel insert need be manufactured and stocked by a casket maker. The universal cap panel insert, sized and configured for use in a cut top casket lid, is also usable in a full top casket dish assembly by employing the conversion kit of the present invention. Furthermore, while each conversion kit preferably includes a pair of conversion cap panel inserts, those conversion inserts can be made identically to one another in view of their reversibility; therefore, only one universal cap panel insert and one conversion cap panel insert need be manufactured and stocked by a casket manufacturer to outfit dish assemblies of both cut top and full top caskets. And, funeral directors may also stock universal cap panel inserts and conversion cap panel inserts for interchanging in cut top and full top caskets as requested or desired by the families.

These and other advantages of the present invention will become more readily apparent during the following detailed description taken in conjunction with the drawings herein, in which:

BRIEF DESCRIPTION OF THE DRAWINGS

FIG. 6C being a view taken along line 6C—6C of FIG. 6B; and

DETAILED DESCRIPTION OF THE INVENTION

Figure 1:
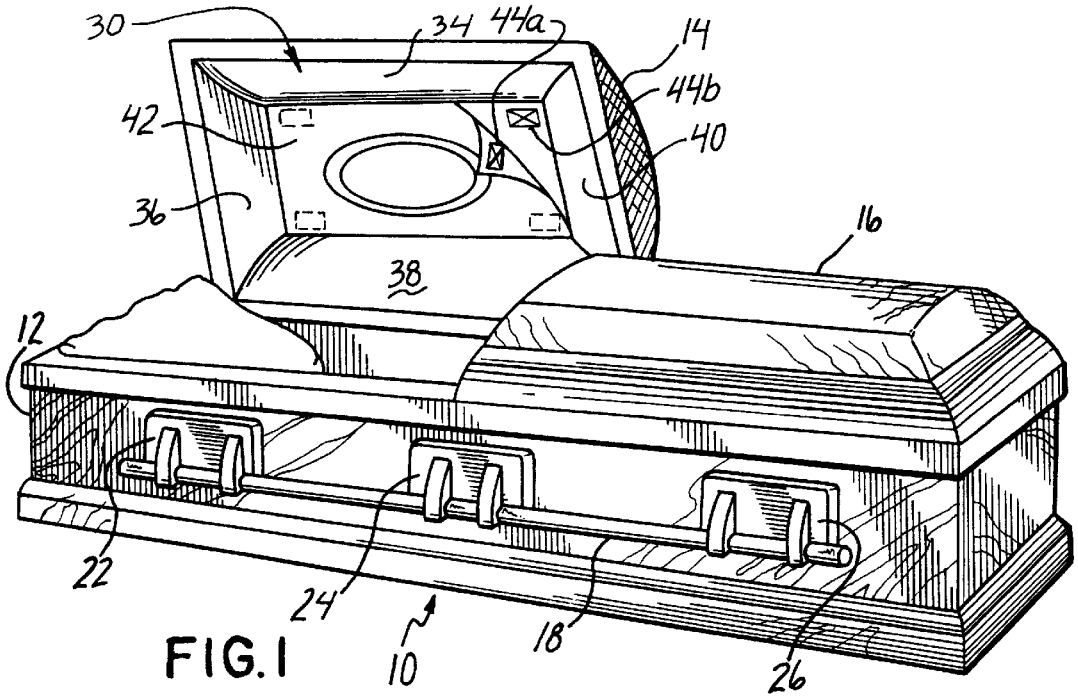
FIG. 1 is a perspective view of a cut top casket with its head end cap in the raised position and illustrating the dish assembly, including cap panel, puffing members and universal cap panel insert.

Referring first to FIG. 1, there is illustrated a casket 10 according to the principles of the present invention. A casket 10 includes a body containing shell 12, a head end cap 14 and a foot end cap 16. Handle 18 and associated handle mounting plates 22, 24 and 26 are provided for lifting the casket 10.

Head end cap 14 includes a dish assembly 30 mounted within an underneath side thereof. Dish assembly 30 includes a rectangular cap panel 32 and convex shaped puffing members 34, 36, 38, 40 mounted around the periphery of the cap panel 32. A decorative and removable cap panel insert 42 is positioned within the dish assembly 30 and against the cap panel 32 and may be removably secured thereto via hook and loop fasteners 44*a*, 44*b*.

Figure 2:
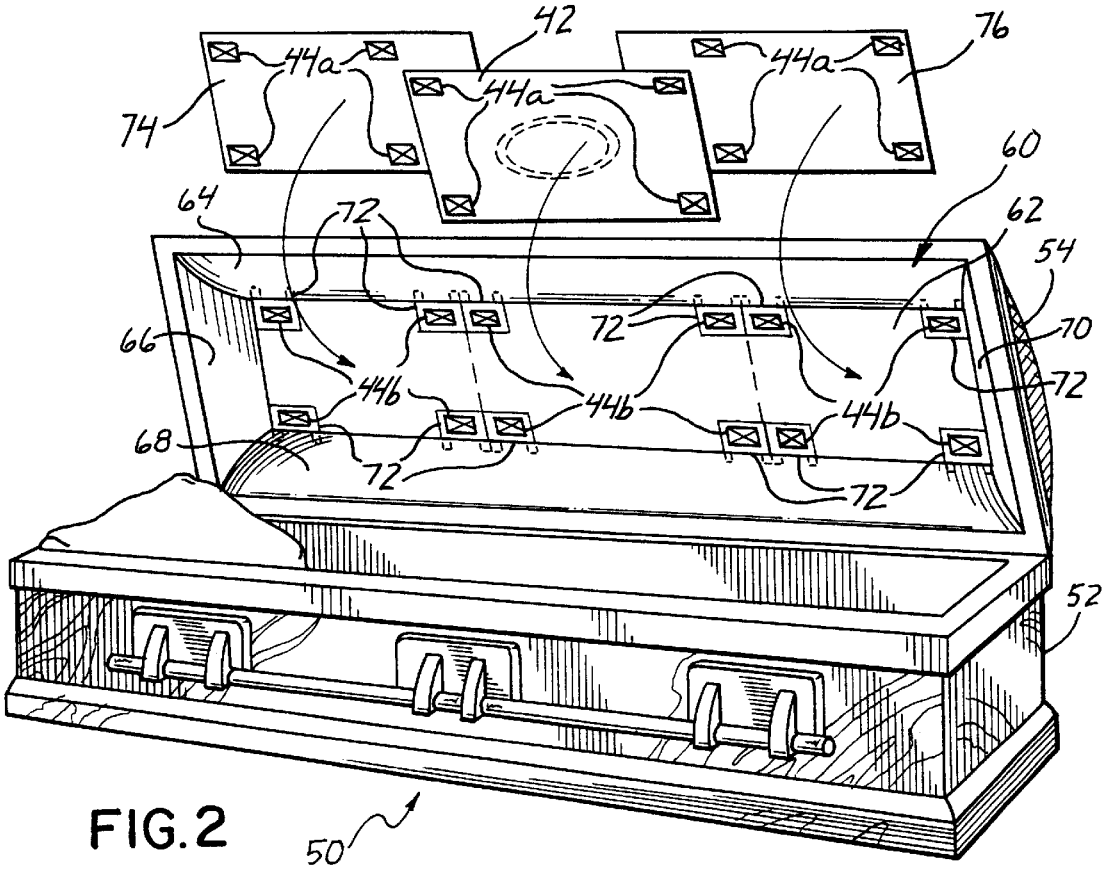
FIG. 2 is a perspective view of a full top casket with its cap in the raised position and illustrating the universal cap panel insert of FIG. 1 utilized in conjunction with a pair of conversion cap panel inserts in a full top dish assembly.

Referring next to FIG. 2, there is illustrated a full top casket 50 which includes a shell 52 and a full-length lid 54. Lid 54 includes a full length dish assembly 60 which comprises a cap panel 62 and puffing members 64, 66, 68, 70. As illustrated, cap panel insert 42 from the cut top casket of FIG. 1 may be installed in the dish assembly 60 of the full top casket of FIG. 2, and preferably in a longitudinally centered location relative to the full top cap panel 62. As such, cap panel insert 42 is a "universal" cap panel insert. A plurality of clips 72 are preferably installed between adjacent edges of the cap panel 62 and puffing members 64, 66, 68, 70 as described in the assignee's U.S. Pat. No. 5,675,877. These clips 72 preferably carry one of the hook and loop portions of the loop type fastener 44*a*, 44*b* referred to above in conjunction with the FIG. 1 description.

Figure 3:
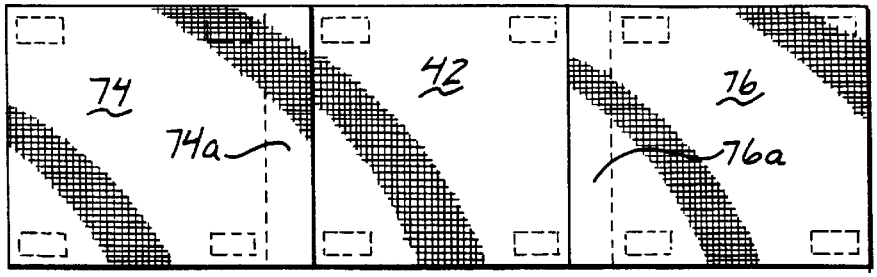
FIG. 3 is a front view of the cap panel inserts of FIG. 2 in their installed orientation in the full top casket dish assembly.

A pair of conversion cap panel inserts 74, 76 are provided for use in conjunction with the universal cap panel insert 42. As illustrated in FIG. 2, the conversion cap panel inserts likewise preferably include one of the hook and loop portions of the hook and loop fasteners 44*a*, 44*b* referred to above. Once the cap panel insert 42 is installed centrally longitudinally of the dish assembly 60, the conversion cap panel inserts 74, 76 may then similarly be installed within the dish assembly 60 again via use of the hook and loop fasteners 44*a*, 44*b* and clips 72. Each conversion cap panel insert 74, 76 includes an integral end edge portion 74*a*, 76*a* respectively which overlies a respective end edge portion of the cap panel insert 42. As is best seen in FIG. 3, it is preferable that the conversion cap panel inserts 74, 76 be sized and configured such that the cap panel insert 42 may be positioned centrally longitudinally of the cap panel 62, and preferably are manufactured such that they are reversible end-to-end of the cap panel 62 so that only one design of conversion cap panel insert need be constructed and stocked by a casket manufacturer.

Figure 4:
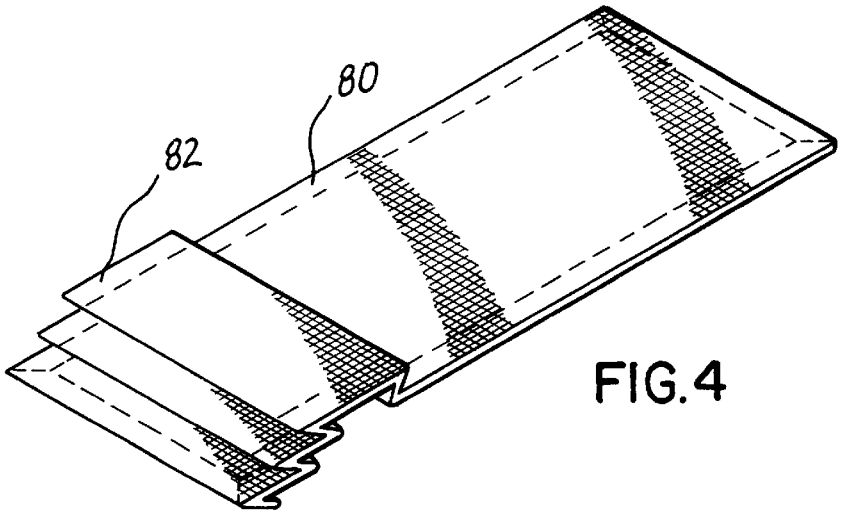
FIG. 4 is a perspective view of one type of conversion cap panel insert including a decorative accordian folded end edge portion.

FIG. 4 illustrates a conversion cap panel insert 80 including a decorative trim piece 82 which is adapted to cover adjacent abutting end edges of the conversion cap panel insert 80 and the universal cap panel insert 42. As illustrated, the decorative trim piece 42 is actually integral with the conversion cap panel insert 80 and is an accordian folded end portion thereof.

Figure 5:
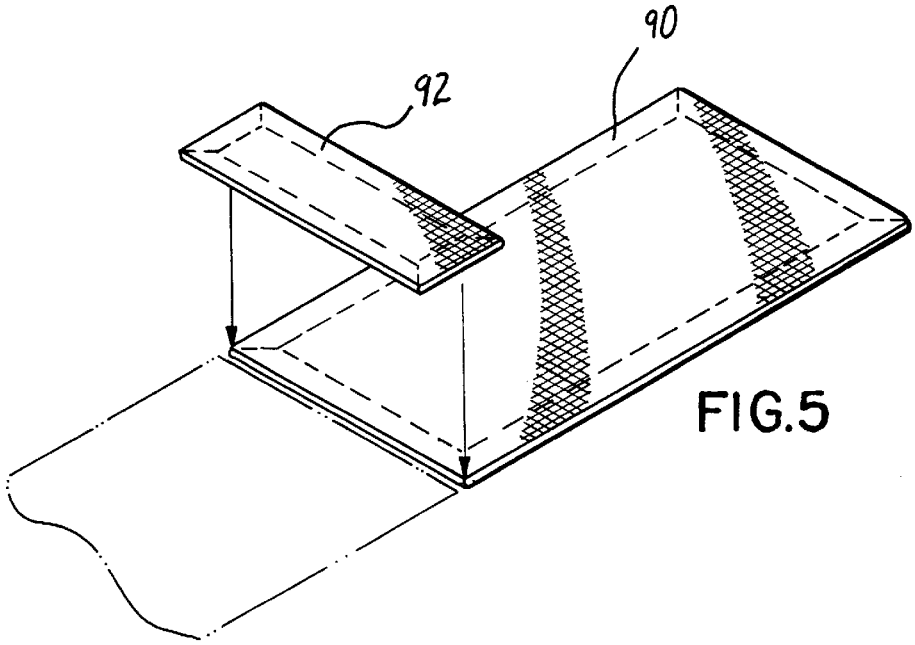
FIG. 5 is a view of another type of conversion cap panel insert which includes a separate decorative trim piece adapted to be attached over adjacent end edge portions of abutting ones of the cap panel inserts.
Figure 6A:
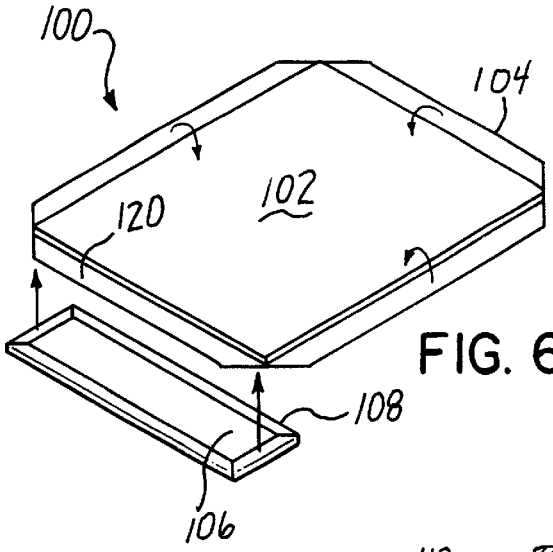
FIGS. 6A–D illustrate a preferable construction technique for constructing a cap panel insert including a decorative trim piece which is integral with respect to the conversion cap panel insert.
Figure 6C:
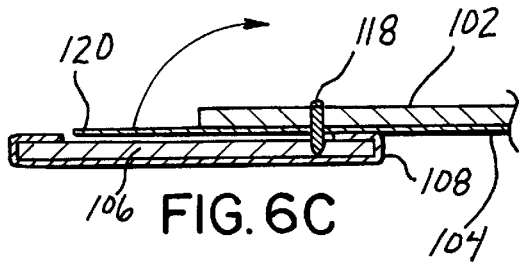
Figure 6B:
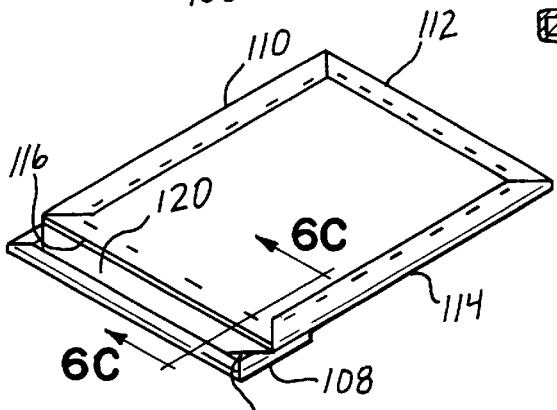
Figure 6E:
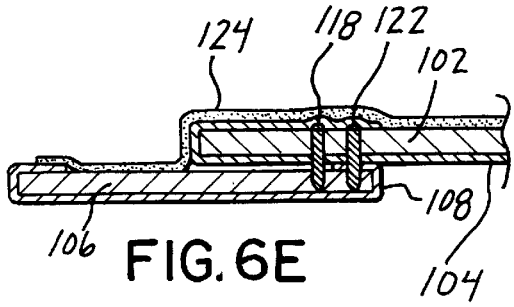
FIG. 6E being a view taken along line 6E—6E of FIG. 6D.
Figure 6D:
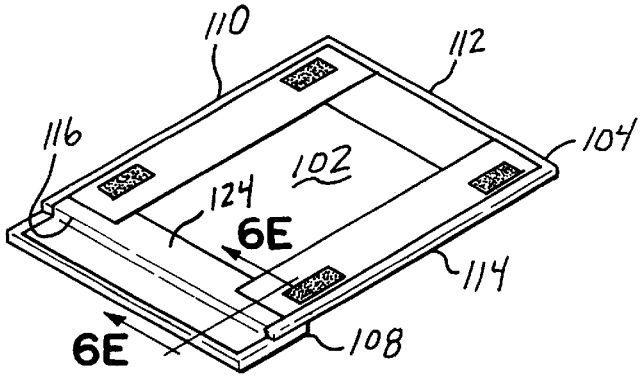

FIG. 5 illustrates an alternative design of conversion cap panel insert. There it will be seen that the conversion cap panel insert 90 has a separate decorative trim piece 92 adapted to be attached over adjacent abutting end edge portions of the conversion cap panel insert 90 and the universal cap panel insert 42. The trim piece 92 may include any number of decorative fabrics thereon, as well as stitched fabric designs, such as shirring or the like. Trim piece 92 may likewise be installed with the use of hook and loop fasteners 44*a*, 44*b* referred to above.

Referring to FIGS. 6A through 6E, there is illustrated a preferred construction of cap panel insert 100 wherein the separate decorative trim portion of FIG. 5 is made integral therewith. In this embodiment, a generally rectangular panel board 102 is covered with fabric 104. A narrow, elongated and generally rectangular trim board 106 is covered with fabric 108. The panel board fabric 104 is preferably stapled to the back side of the panel board 102 along three edges 110, 112, 114. Along the fourth edge 116, the panel board 102 is first stapled to the fabric covered trim board 106 as at 118 and then the panel board fabric 120 along the fourth edge 116 is folded back upon the panel board 102 and stapled thereto as at 122. Then, vinyl tape 124 is applied to the connection of the panel board 102 and to the trim board 106 on their respective back sides.

In use, universal cap panel inserts and cap panel conversion kits can be utilized by the casket manufacturer, the funeral home, or both. In the case of the casket manufacturer, the manufacturer would likely fabricate a number of universal cap panel inserts and conversion kits and keep them in stock. The casket manufacturer would then draw from that stock as needed to produce its cut top and full top caskets. The funeral home on the other hand would likely keep a limited number of universal cap panel inserts and conversion kits available to swap out among its caskets on hand, depending upon the requests of the family. A casket manufacturer would likely produce more universal cap panel inserts and conversion kits than it would need solely for its cut top and full top casket production in order to have sufficient numbers of these items to sell directly to funeral homes.

Those skilled in the art will readily recognize numerous adaptations and modifications which can be made to the present invention which will result in an improved dish assembly, yet all of which will fall within the spirit and scope of the present invention as defined in the following claims. Accordingly, the invention is to be limited only by the scope of the following claims and their equivalents.

What is claimed is:

1. A dish assembly adapted to be positioned in a lid of a full top casket, said assembly comprising:

a cap panel sized and configured to fit within the full top casket lid and puffing members attached to said panel around a periphery thereof;

a first cap panel insert overlying said cap panel; and a cap panel sized and configured to fit within the full top casket lid and puffing members attached to said panel around a periphery thereof;

a first cap panel insert overlying said cap panel; and second and third cap panel inserts positioned at opposite longitudinal ends of said first cap panel insert and overlying said cap panel;

said first cap panel insert sized and configured to fit within a dish assembly of a cut top casket;

further including a decorative trim piece covering adjacent end edge portions of said first, second and third inserts;

wherein each said decorative trim piece is integral with a respective one of said second and third inserts;

wherein each said trim piece is an accordion folded said end edge portion of said second and third inserts.

2. The assembly of claim 1 wherein said second and third inserts are sized and configured so that said first insert may be positioned centrally longitudinally of said cap panel.

3. The assembly of claim 2 wherein said second and third inserts are reversible end-to-end of said cap panel.

4. The assembly of claim 1 further including a decorative trim piece covering adjacent end edge portions of said first, second and third inserts.

5. The assembly of claim 4 wherein each said decorative trim piece is integral with a respective one of said second and third inserts.

6. The assembly of claim 4 wherein each said decorative trim piece is a separate piece attached over said adjacent end edge portions of said first, second and third inserts.

7. The assembly of claim 6 wherein each said trim piece includes shirred fabric thereon.

8. A dish assembly adapted to be positioned in a lid of a full top casket, said assembly comprising:

a cap panel sized and configured to fit within the full top casket lid and puffing members attached to said panel around a periphery thereof;

a first cap panel insert overlying said cap panel; and second and third cap panel inserts positioned at opposite longitudinal ends of said first cap panel insert and overlying said cap panel;

said first cap panel insert sized and configured to fit within a dish assembly of a cut top casket;

wherein an integral end edge portion of a respective one of said second and third inserts overlies a respective end edge portion of said first insert.

9. A dish assembly adapted to be positioned in a lid of a full top casket, said assembly comprising:

a cap panel sized and configured to fit within said full top casket lid and puffing members attached to said panel around a periphery thereof;

a first cap panel insert overlying said cap panel; and second and third cap panel inserts positioned at opposite longitudinal ends of said first cap panel insert and overlying said cap panel;

said first cap panel insert sized and configured to fit within and substantially completely fill a dish assembly of a cut top casket;

said first, second and third cap panel inserts sized and configured to fit within and substantially fill said full top casket dish assembly.

10. A casket comprising:

a shell;

a full top lid enclosing said shell; and a dish assembly positioned in said lid, said dish assembly comprising:

second and third cap panel inserts positioned at opposite longitudinal ends of said first cap panel insert and overlying said cap panel;

said first cap panel insert sized and configured to fit within and substantially completely fill a dish assembly of a cut top casket;

said first, second and third cap panel inserts sized and configured to fit within and substantially completely fill said full top casket dish assembly.

11. The assembly of claim 10 wherein said second and third inserts are sized and configured so that said first insert may be positioned centrally longitudinally of said cap panel.

12. The assembly of claim 11 wherein said second and third inserts are reversible end-to-end of said cap panel.

13. The assembly of claim 10 further including a decorative trim piece covering adjacent end edge portions of said first, second and third inserts.

14. The assembly of claim 13 wherein each said decorative trim piece is integral with a respective one of said second and third inserts.

15. The assembly of claim 13 wherein each said decorative trim piece is a separate piece attached over said adjacent end edge portions of said first, second and third inserts.

16. A casket comprising:

a shell;

a full top lid enclosing said shell; and a dish assembly positioned in said lid, said dish assembly comprising:

a cap panel sized and configured to fit within said full top casket lid and puffing members attached to said panel around a periphery thereof;

a first cap panel insert overlying said cap panel; and second and third cap panel inserts positioned at opposite longitudinal ends of said first cap panel insert and overlying said cap panel;

said first cap panel insert sized and configured to fit within a dish assembly of a cut top casket;

wherein an integral end edge portion of a respective one of said second and third inserts overlies a respective end edge portion of said first insert.

17. A casket comprising:

a shell;

a full top lid enclosing said shell; and a dish assembly positioned in said lid, said dish assembly comprising:

a cap panel sized and configured to fit within said full top casket lid and puffing members attached to said panel around a periphery thereof;

a first cap panel insert overlying said cap panel; and second and third cap panel inserts positioned at opposite longitudinal ends of said first cap panel insert and overlying said cap panel;

said first cap panel insert sized and configured to fit within a dish assembly of a cut top casket;

further including a decorative trim piece covering adjacent end edge portions of said first, second and third inserts;

wherein each said decorative trim piece is integral with a respective one of said second and third inserts;

wherein each said trim piece is an accordion folded said end edge portion of said second and third inserts.

18. The assembly of claim 17 wherein each said trim piece includes shirred fabric thereon.

19. A conversion kit for converting a cap panel insert sized and configured for a cut top casket lid for use in a full top casket lid, said kit comprising:

a pair of conversion cap panel inserts, both of which are sized and configured to be positioned at opposite longitudinal ends of the cut top casket lid cap panel insert such that the cut top casket lid cap panel insert and said pair of conversion cap panel inserts substantially completely cover a cap panel of a dish assembly sized and configured for installation in the full top casket lid.

20. The conversion kit of claim 19 wherein said pair of conversion cap panel inserts are sized and configured so that the cut top casket cap panel insert may be positioned centrally longitudinally of the cap panel of the dish assembly in the full top casket.

21. The conversion kit of claim 20 wherein said pair of conversion cap panel inserts are adapted to be reversible end-to-end of the cut top casket cap panel insert.

22. The conversion kit of claim 19 wherein an integral end edge portion of a respective one of said pair of conversion cap panel inserts is adapted to overly a respective end edge portion of the cut top casket cap panel insert.

23. The conversion kit of claim 19 further including a decorative trim piece adapted to cover adjacent end edge portions of said pair of conversion cap panel inserts and the cut top casket cap panel insert.

24. The conversion kit of claim 23 wherein each said decorative trim piece is integral with a respective one of said pair of conversion cap panel inserts.

25. The conversion kit of claim 23 wherein each said decorative trim piece is a separate piece adapted to be attached over said adjacent end edge portions of said pair of conversion cap panel inserts and the cut top casket cap panel insert.

26. The conversion kit of claim 25 herein each said trim piece includes shirred fabric thereon.

27. A conversion kit for converting a cap panel insert sized and configured for a cut top casket lid for use in a full top casket lid, said kit comprising:

a pair of conversion cap panel inserts, both of which are sized and configured to be positioned at opposite longitudinal ends of the cut top casket lid cap panel insert such that the cut top casket lid cap panel insert and said pair of conversion cap panel inserts cover a cap panel of a dish assembly sized and configured for installation in the full top casket lid;

further including a decorative trim piece adapted to cover adjacent end edge portions of said pair of conversion cap panel inserts and the cut top casket cap panel insert;

wherein each said decorative trim piece is integral with a respective one of said pair of conversion cap panel inserts;

wherein each said trim piece is an accordion folded said end edge portion of said pair of conversion cap panel inserts.

28. A conversion cap panel insert for use in converting a cut top casket cap panel insert for use in a full top casket, said conversion cap panel insert comprising:

a generally rectangular panel board covered with fabric; and a generally rectangular trim board, covered with fabric, and having a longitudinal edge portion overlying and secured to a longitudinal edge portion of said panel board.

29. The conversion cap panel insert of claim 28 wherein said panel board fabric is stapled to a back side of said panel board along three edges, and along a fourth edge said panel board is first stapled to said fabric covered trim board and then said panel board fabric along the fourth edge is folded back upon said panel board and is stapled thereto.

30. The conversion cap panel of claim 29 further including vinyl tape overlying the connection of said panel board and trim board on respective back sides thereof.

31. A method of manufacturing cut top and full top caskets comprising:

providing universal cap panel inserts sized and configured to fit within a dish assembly of the cut top casket;

providing conversion kits including a pair of conversion cap panel inserts sized and configured to, when combined with one of the universal cap panel inserts, fit within a dish assembly of the full top casket;

installing the universal cap panel insert in the dish assemblies of the cut top caskets; and installing the universal cap panel insert and the pair of the conversion cap panel inserts in the dish assemblies of the full top caskets.

32. The method of claim 31 wherein the providing steps and the installing steps are performed by a casket manufacturer.

33. The method of claim 31 wherein the providing steps and the installing steps are performed by a funeral home.

34. The method of claim 31 further comprising:

fabricating the universal cap panel inserts and conversion kits;

stocking the universal cap panel inserts and conversion kits; and removing the universal cap panel inserts and conversion kits from stock as needed to produce cut top and full top caskets.

35. A dish assembly adapted to be positioned in a lid of a casket, said dish assembly comprising:

a cap panel;

a first cap panel insert overlying said cap panel, said first cap panel having opposite end edge portions; and a second cap panel insert overlying said cap panel, said second cap panel insert having an end edge portion overlying one of said end edge portions of said first cap panel insert.

36. The dish assembly of claim 35 wherein said dish assembly is configured to fit within a lid of a full top casket, and said first cap panel insert is configured to fit within a dish assembly of a cut top casket.

37. The dish assembly of claim 35 wherein said dish assembly is configured to fit within and substantially completely fill a lid of a full top casket, and said first cap panel insert is configured to substantially completely fill a dish assembly of a cut top casket.

38. The dish assembly of claim 35 further including a third cap panel insert, said third cap panel insert having an end edge portion overlying the other of said end edge portions of said first cap panel insert.

* * * * *

UNITED STATES PATENT AND TRADEMARK OFFICE

CERTIFICATE OF CORRECTION

PATENT NO. : 6,742,231 B1
APPLICATION NO. : 09/494028
DATED : June 1, 2004
INVENTOR(S) : Rosalie J. Calhoun et al.

It is certified that error appears in the above-identified patent and that said Letters Patent is hereby corrected as shown below:

Column 5, lines 12-15, "a cap panel sized and configured to fit within the full top and casket lid and puffing members attached to said panel around a periphery thereof ; a first cap panel insert overlying said cap panel ; and" should be deleted.

Column 6, line 5, "substantially fill" should be --substantially completely fill--.

Column 6, line 11, "comprising:" should be --comprising: a cap panel sized and configured to fit within said full top casket lid and puffing members attached to said panel around a periphery thereof ; a first cap panel insert overlying said cap panel; and--.

Column 7, line 44, "herein" should be --wherein--.

Column 5, line 28, "The assembly of claim 1" should be --The assembly of claim 9--.

Column 5, line 33, "The assembly of claim 1" should be --The assembly of claim 9--.

Signed and Sealed this

Second Day of January, 2007

JON W. DUDAS
*Director of the United States Patent and Trademark Office*